US006119056A

United States Patent [19]

Beike

[11] Patent Number: 6,119,056

[45] Date of Patent: Sep. 12, 2000

[54] METHOD AND APPARATUS FOR GENERATING A SENSOR SIGNAL

[75] Inventor: Johannes Beike, Unterlüss, Germany

[73] Assignee: TZN Forschungs-und Entwicklungszentrum, Unterluss, Germany

[21] Appl. No.: 09/028,079

[22] Filed: Feb. 23, 1998

[30] Foreign Application Priority Data

Feb. 22, 1997 [DE] Germany ..... 197 07 175

[51] Int. Cl.[7] ..... G06F 17/00; G06F 7/00

[52] U.S. Cl. ..... 701/19; 701/20; 246/6; 104/284

[58] Field of Search ..... 701/19, 20, 38, 701/70, 72, 79, 110; 246/1 C, 6, 34 CT; 104/284

[56] References Cited

U.S. PATENT DOCUMENTS

| | | | |
|---|---|---|---|
| 4,235,402 | 11/1980 | Matty et al. | 701/20 |
| 4,267,736 | 5/1981 | Westbeck | 701/19 |
| 4,459,668 | 7/1984 | Inoue et al. | 701/20 |
| 5,471,387 | 11/1995 | Wood et al. | 701/19 |

*Primary Examiner*—William A. Cuchlinski, Jr.
*Assistant Examiner*—Gertrude Arthur
*Attorney, Agent, or Firm*—Venable; Norman N. Kunitz

[57] ABSTRACT

A method and an apparatus for generating a sensor signal related a track-banking angle of a banked section of track traversed by a train car wherein a track-banking angle value basically is determined from measured values of the rolling angular speed and yaw speed of the car chassis. A track-banking angle (Φg) is determined in an observer unit (2), preferably estimated by use of an inverse gyro system simulation (10) of a measured-value generator (6), and compared, as an estimated track-banking angle (Φgb), to a track-banking angle (Φgs) determined from the transverse acceleration (aq), the yaw speed (ωG) and the train speed (v), as information about the track-banking angle (Φg). A resulting difference (ΔΦg) is filtered via a regulating circuit formed by a feedback from a comparator (11) to the inverse gyro system simulator (10). This signal, in the form of a track-banking angle (Φb), as the signal representing the real track-banking angle (Φg), can be fed subsequently to an angle-of-inclination generator unit (4) for generating an actuation and switching signal ($\phi_N$) for controlling the car chassis inclination. A further observer unit (3) can be integrated into the system for increasing the dynamics. Track path data and track geometries are stored in this further observer unit (3), so that when a track path is recognized, it is possible to preset a control system (5) or the actual car-body inclination system (1).

13 Claims, 3 Drawing Sheets

METHOD AND APPARATUS FOR GENERATING A SENSOR SIGNAL

REFERENCE TO RELATED APPLICATIONS

This application claims the priority of German application Serial No. 197 07 175.9, filed Feb. 22, 1997, which is incorporated herein by reference.

BACKGROUND OF THE INVENTION

The invention relates to a method and an apparatus for generating a sensor signal for a track-banking-dependent inclination of a rail vehicle with the use of measured signals for the train speed, for the angular speed of a train car chassis about the roll axis, and for the transverse acceleration.

Due to increased speeds in rail-bound passenger travel as a means of shortening travel times, a track-curve-dependent inclination regulation or control of the car-body inclination system is desired for traversing curves, that is, curved tracks. In this regulation or control, the negative transverse acceleration increases that occur during traversing of curved tracks should be avoided or minimized to prevent a loss of comfort for the passengers, despite the increased train speeds.

Known means for achieving this are active and passive inclination adjustments. In an active action, the inclination of the car body is adjusted or changed, while the pendulum oscillation of the car body is utilized in a passive action.

In an active action, a value that is used as a relevant value for the effective transverse acceleration is used as a signal. An example of a value of this type is the angle of inclination of the car body with respect to the ground, that is, the earth's surface, which is assumed to extend horizontally. This angle of inclination is added to a track banking or super-elevation angle, and is a function of the geometry of the curved track and the train speed.

German Patent No. DE 37 27 768 C1 discloses a method and an apparatus for generating an actuating signal for the curved-track-dependent inclination of a car body. The actuation signal is generated with the use of measured signals for the vehicle speed, the angular speed of the vehicle frame about a longitudinal axis oriented in its direction of travel, and the transverse acceleration perpendicular to the direction of travel and parallel to the track plane. A drawback here is that the transverse acceleration, and not a track banking, is used to form the actuation signal. Only a roll angle integrated from the rolling speed is determined for activating and deactivating the inclination control. The integration of the gyro offset, however, results in a roll-angle drift that renders the switching process functional for only a short time. To lengthen the function time, gyros having a small gyro offset are necessary, resulting in a high-cost generation of the actuation signal.

German Patent No. DE 27 05 221 C2 discloses an arrangement for controlling an inclination apparatus in which the noise-infested measured signals of an acceleration sensor are replaced by measurements with a roll gyro and a yaw gyro. This avoids unallowable time delays in the generation of the actuation signal that result during a necessary, heavy filtering of the measured signal of the acceleration sensor. However the integration of the roll angle from the roll speed brings about the drawbacks outlined above.

It is the object of the present invention to provide a method and an apparatus with which a sensor signal containing information about a track banking is generated in a simple and effective manner.

SUMMARY OF THE INVENTION

The above object generally is achieved according to the present invention by a method of generating a sensor signal related to a track-banking angle of a banked section of track traversed by a train, with the method comprising the steps of:

providing measured signal values for the train speed, for the angular speed of a train car chassis about the roll axis, for the transverse acceleration, and for the yaw speed of the chassis about the yaw axis; and determining a track-banking angle value from the rolling angular speed and the yaw speed of the chassis about the yaw axis. The determined track-banking angle value and the measured values can be used to generate an actuation signal to control a control system for the regulation of the inclination of a train car chassis.

The invention is based on the idea of determining a track-banking angle from a roll speed and an additionally-measured yaw speed. The track-banking angle is determined through an additional observation or estimation of the track banking. From the observed or estimated track banking, a signal is generated that must be filtered if a small difference exists between a signal that has already been generated in a simulated model and a measured signal.

Thus, the advantages of a gyro sensor (low noise) are combined with the advantages of an acceleration sensor (no drift). To permit this, a track banking angle that is noise-free, but is affected by drift, is estimated from the gyro sensor signal with the aid of a simulated model that is inverse to the gyro. At the same time, the track banking angle is measured, drift-free but affected by noise, by the acceleration sensor. To determine the track banking angle with the acceleration sensor, an additional measurement of the yaw speed, as the rotational speed about the vertical axis of the rail car bogie or truck, and a measurement of the train speed, is performed for calculating the centrifugal force as an interference value from the measured track banking angle of the acceleration sensor. A difference is determined from the track-banking values of the gyro model and the acceleration sensor, which are present in signal form. Even with noise interferences, a subtraction is performed, so only the difference value is affected by noise. Through feedback into the inverse gyro model, this difference value is readjusted to zero and filtered. Because only drifts are compensated, the readjustment is effected very slowly, and provides a noise-free actuating signal to a downstream control system.

With this method, the limit frequency of filtering of the interferences in the acceleration signal of the acceleration recorder can be reduced significantly without a reduction in the dynamics of the track banking angle measurement. Because the gyro drift is compensated, low-cost gyros can be used.

With the incorporation of the sensor components, for example, offset values, into the simulation model, estimation with the model is more precise. Another advantage is the integration of known path data into the system, which increases the dynamics of the system for determining the track-banking angle.

BRIEF DESCRIPTION OF THE DRAWINGS

The invention is described in detail below by way of an embodiment illustrated in the drawings.

BRIEF DESCRIPTION OF THE PREFERRED EMBODIMENTS

Figure 1:
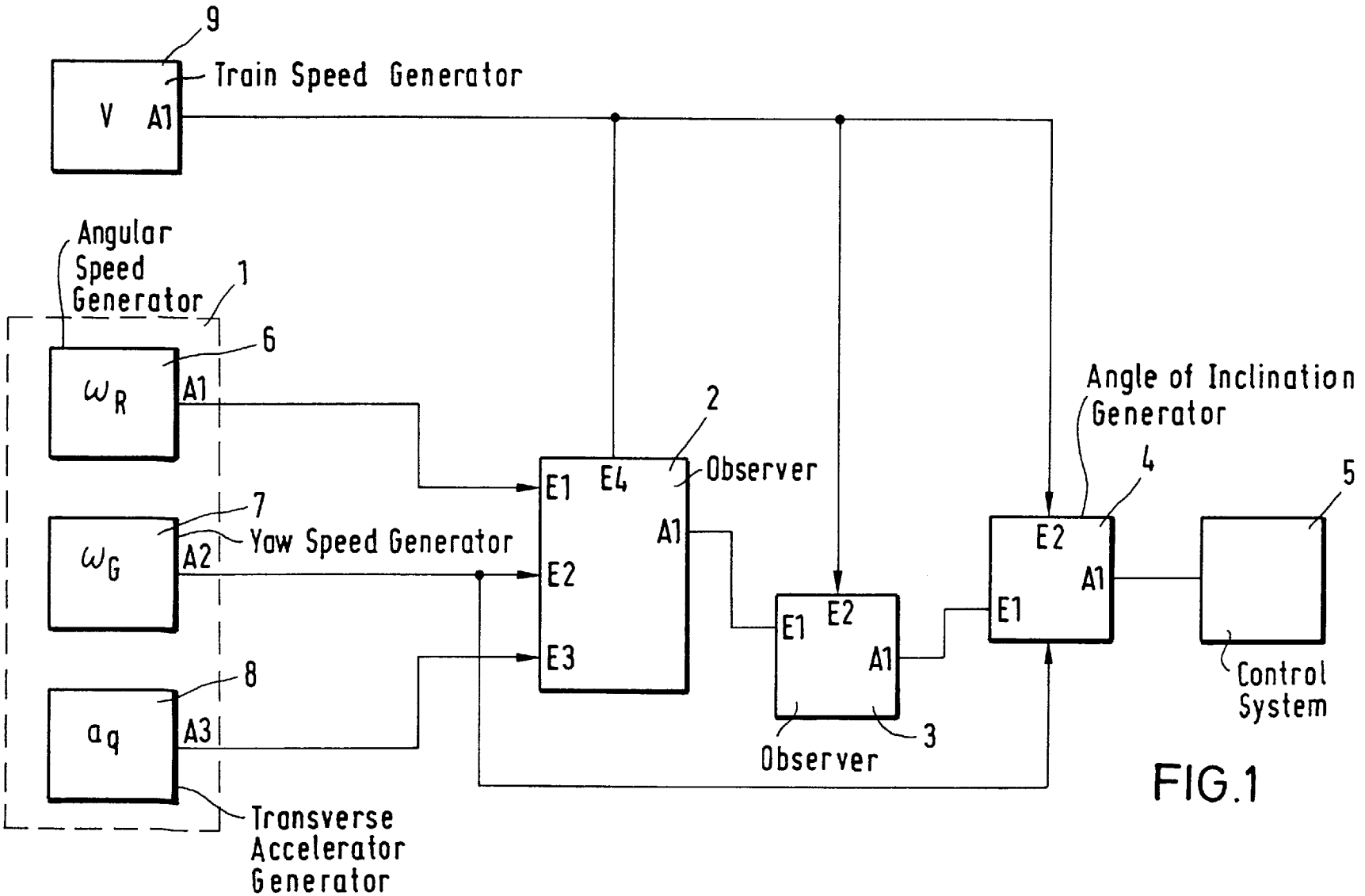
FIG. 1 is a circuit diagram of an arrangement according to the invention for determining an observed track banking.

FIG. 1 shows a sensor group 1, an observer unit 2 and a further observer unit 3, as well as an angle-of-inclination generator unit 4 and a control system 5 of an actual car or train body, not shown in detail. Sensor group 1 preferably comprises a measured-value generator 6 for detecting the angular speed ωR in the roll plane, a measured-value generator 7, for example a gyro, for detecting the angular speed ωG in the yaw plane, and a measured-value generator 8, for example, an acceleration sensor, for detecting the transverse acceleration aq. Sensor group 1 is preferably disposed on the chassis of the car body, not shown, and advantageously disposed horizontally with respect to the earth's surface. The train speed v is usually determined with a measured-value generator 9 that is already present in the train. Outputs A1, A2 and A3 of sensor group 1, and thus the outputs of respective measured-value generators 6, 7 and 8, are connected to suitable inputs E1, E2 and E3, respectively, of observer unit 2.

An input E4 of observer unit 2 is connected with an output A1 of measured-value generator 9, with this output A1 of generator 9 being simultaneously connected to an input E2 of the observer unit 3 and an input E2 of to angle-of-inclination generator unit 4.

An output A1 of observer unit 2 is connected with an input E1 of observer unit 3. An output A1 of observer unit 3 is connected to an input E1 of the angle-of-inclination generator unit 4. An output A1 of this angle-of-inclination generator unit 4 is connected to the control system 5.

Figure 2:
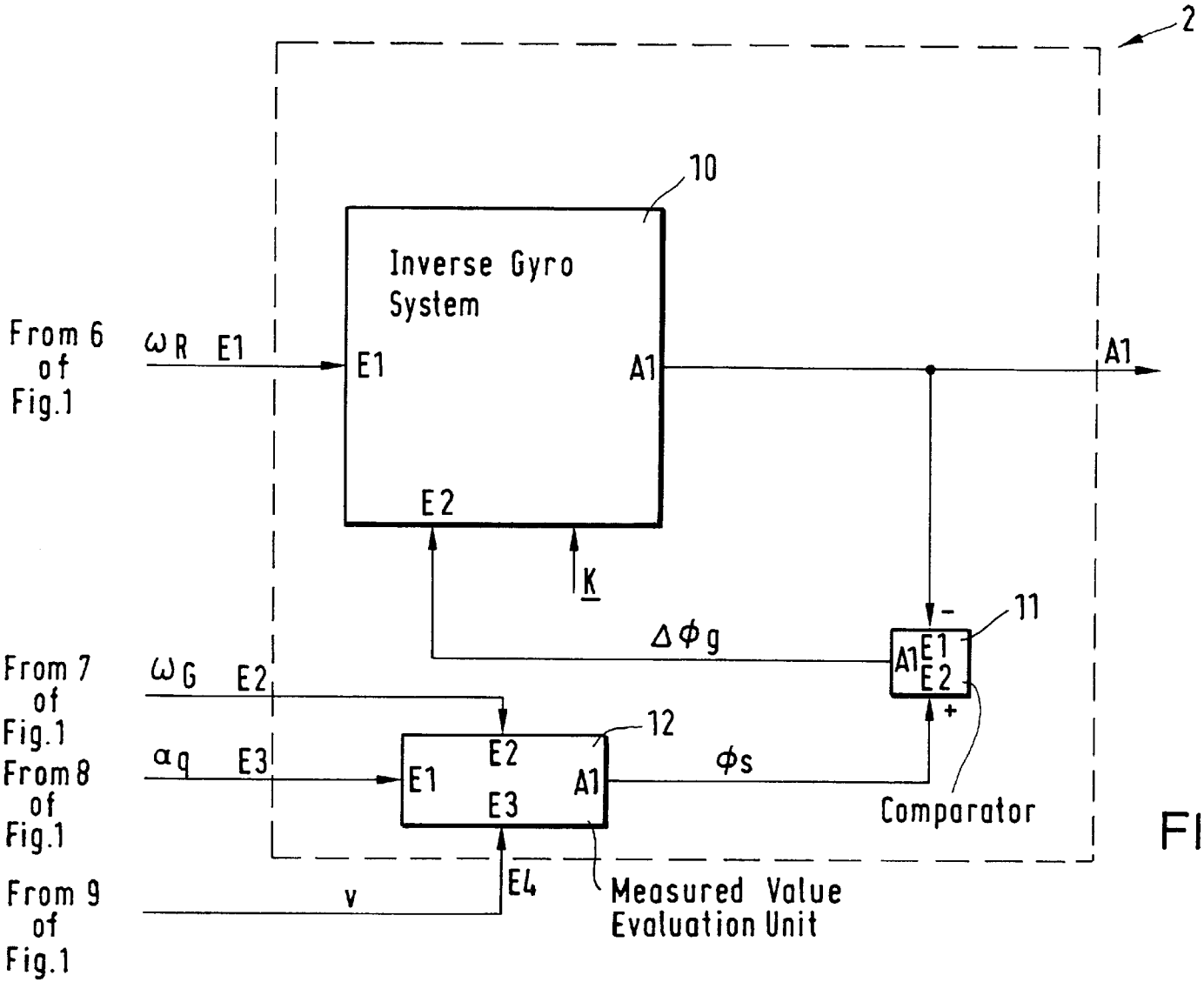
FIG. 2 shows the internal structure of the observer unit 2 of FIG. 1.

FIG. 2 shows the internal structure of observer unit 2. Here a simulation of the inverse gyro system for signal sensor 6 is indicated by 10, and a comparator 11 has an input E1 connected to output A1 of the simulated inverse gyro system 10, and an output A1 connected to input E2 of the simulated inverse gyro system 10. A further input E2 of comparator 11 is connected to output A1 of a measured-value evaluation unit 12, while input E1 of observer unit 2 is connected to input E1 of the simulated inverse gyro system 10. Output A1 of the simulated inverse gyro system 10 is guided as output A1 out of observer unit 2. Inputs E1, E2 and E3 of measured-value evaluation unit 12 are connected to measured-value generators 7, 8 and 9 via the suitable inputs E3, E2 and E4, respectively, of observer unit 2.

Figure 3:
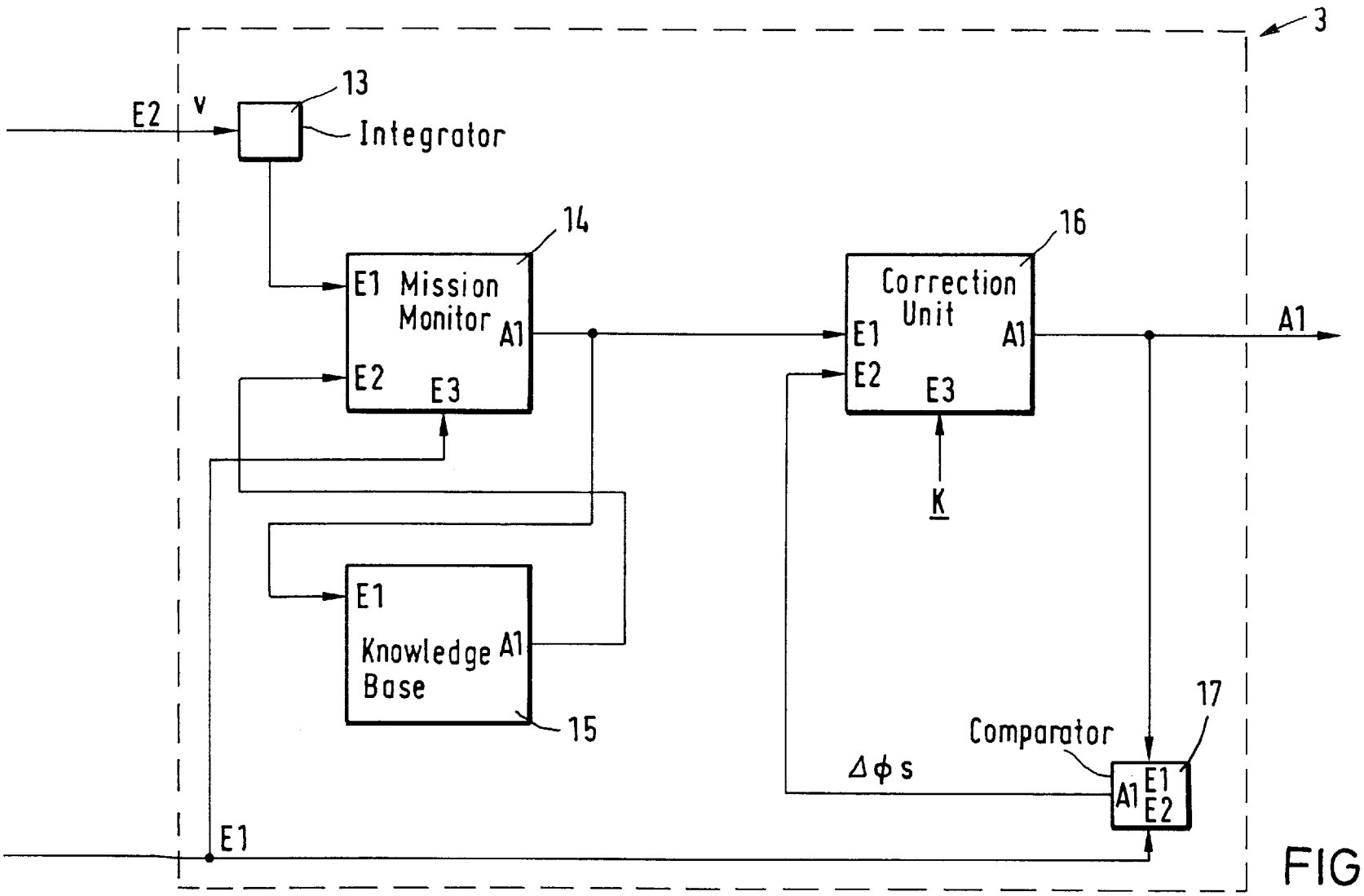
FIG. 3 shows the internal structure of the further observer unit 3 of FIG. 1.

FIG. 3 illustrates the internal structure of observer unit 3. A train-speed integrator 13, which calculates the current or present path of the train from train speed v, is connected to input E2 of observer unit 3. Connected downstream of train-speed integrator 13 via an input E1 is a mission monitor 14, whose other input E2 is connected to an output A1 of a knowledge base 15. On the output side, mission monitor 14 is connected with an input E1 of knowledge base 15 and an input E1 of a correction unit 16. Input E1 of observer unit 3 is connected to input E3 of mission monitor 14, with also being connected to an input E2 of a comparator 17. An output A1 of comparator 17 is connected to an input E2 of correction unit 16, while a further input E1 of comparator 17 is connected to an output A1 of correction unit 16; this output A1 of correction unit 16 also functions as output A1 of observer unit 3.

The method according to the invention is effected as follows:

Measured-value generator 9 determines the train speed v in a conventional manner, and transmits this value, as an output signal representing train speed v, to input E4 of observer unit 2. Measured-value generators 6 and 7 respectively measure the angular speeds ωR and ωG, which occur about the roll axis and the vehicle axis, respectively, and are present as corresponding generator output signals at inputs E2 and E1 of observer unit 2. From measured-value generator 8, input E3 of observer unit 2 obtains a signal representing the transverse acceleration aq on the rail plane.

If a rail vehicle traverses a straight path segment that does not include a banked curve, train speed v is measured by measured-value generator 9. Measured-value generators 6 and 8 generate only a few signals, because only a minimal transverse inclination of the actual car body occurs. Observer unit 2 does not activate control system 5, because the track banking does not exceed a set minimum value for same.

When a curved-track path is entered, the rail vehicle proceeds onto a banked curve characterized by a real track-banking angle Φg. Because of the established transverse inclination of the actual car body, the chassis rotates about its roll axis, so an angular speed ωR occurring about the roll axis is measured by measured-value generator 6 and fed to input E1 of the observer 2.

As dictated by the technical data of measured-value generator 6, the measured rolling angular speed ωR is imprecise. To eliminate this imprecision, an angular speed ωs is estimated by the simulated inverse gyro system 10 of observer unit 2 in a known manner. For this purpose, the measured rolling angular speed ωR is connected to input E1 of the simulated system 10. Technical data of measured-value generator 6 are considered as an inverse model in this system 10, eliminating construction-based deficiencies. For example, the offset of measured-value generator 6, which is predetermined in the specification sheets, is considered in that it is incorporated as an inverse value in the simulated model of system 10, and the angular speed ωs determined as an estimated angular speed ωs in this manner corresponds approximately to the real rolling angular speed ωR. In addition, the dynamic elements of the gyro of generator 6, such as delaying elements, can be compensated by their inverse elements, such as leading elements, in the inverse simulation model of gyro system 10. The estimation of the real rolling angular speed ωR is made more precise by the inverse compensation. An observed (estimated) track-banking angle Φgb is generated from this determined/estimated angular speed ωs in a known manner. To this end, this observed track-banking angle Φgb is integrated from the angular speed ωs. As stipulated by this integration, the determined value of the observed track-banking angle Φgb is affected by drift, and the imprecision of the value therefore increases over time.

However, the signals present at inputs E2, E3 and E4 of observer unit 2 are used for determining the real track-banking angle Φg. In measured-value evaluation unit 12, a track-banking angle Φgs is calculated from the train speed v, the yaw speed ωG of the rail car bogie or truck, the transverse acceleration aq occurring on the rail plane, and the gravitational acceleration g. For this purpose, in the unit 12, the centrifugal force established as an interfering value during a transverse acceleration is calculated in a known manner from the signal aq of measured-value generator 8 with the aid of the yaw angular speed ωG and train speed v.

The track-banking angle Φgs calculated from these measured signals is identical in value to the real track-banking angle Φg, but includes large interference signals. Therefore, the observed or estimated track-banking angle Φgb, which is affected by drift, and the measured (calculated) track-banking angle Φgs, which is affected by interference, are compared by comparator 11. A resulting difference ΔΦg comprises the observed (estimated) track-banking angle Φgb affected by drift, minus the track-banking angle Φgs affected by interferences, and forms a difference ΔΦg to be readjusted (suppressed). This difference ΔΦg, comprising the gyro drift and interferences of the measured signal of measured-value generator 8, is filtered and regulated to zero in the regulating circuit as a result of the feedback from comparator 11 to the simulated system 10. The temporal regulation results from the feedback factor K of the regulating circuit closed by the formation of the difference. Through the presetting of feedback factor K, the dynamics of the regulating circuit (observer poles) is selected to be very small, preferably 0.1 Hz. The brief interferences to the measured signal of measured-value generator 8 are filtered heavily in the difference ΔΦg, and transition, in considerably-reduced form, into an observed or estimated, real track-banking angle Φb. A real, observed track-banking angle Φb representing the real track-banking angle Φg thus is present at output A1 of the simulated gyro system 10, and thus simultaneously at output A1 of observer unit 2. In terms of value, this angle Φb results from the observed (estimated) track-banking angle Φgb affected by drift and the measured track-banking angle Φgs affected by interference, as well as the difference ΔΦg to be readjusted (suppressed).

The further observer unit 3 can be integrated or incorporated into the system to increase the dynamics of the above-described determination of a track-banking angle Φb. In this case, known information, such as track geometry, positions of active and passive path markers (e.g., code transmitters, magnets) and special features of the path, for example stopping stations, are entered into and stored in knowledge base 15.

Mission monitor 14 determines the instantaneous train position via use of the current integrated speed, signal present at its input E1. From knowledge base 15, monitor 14 obtains the current path or position data that have been determined from the integrated train speed v. The current position data, such as a track banking angle stored in knowledge base 15, are compared in mission monitor 14 to the observed or estimated track-banking angle Φb fed to input E3 of mission monitor 14, and, when the path is recognized, observer unit 3 switches into the system, that is, observer unit 3 becomes active and increases the dynamics of the actuation signal for the track-curve-dependent inclination. A presetting of the inclination at control system 5 can be effected with a previously-stored track-banking angle Φgw when mission monitor 14 recognizes the path. The difference signal ΔΦs necessary for the precise adjustment (readjustment) of the track banking angle Φgw known from knowledge base 15, is supplied by the comparator 17 from the track-banking angle ogw known from the knowledge base, and the real track-banking angle Φb estimated, in observer unit 2, and fed to be correction unit 16. This difference signal ΔΦs is regulated to zero in the unit 16 by a delaying feedback K, similarly to observer unit 2. Due to the filtering of the observed track-banking angle Φb, which is effected by the feedback of difference signal ΔΦs, interference signals are additionally damped.

If observer unit 3 is inactive, this track-banking angle Φb fed to the observer 3 via its input E1 is simultaneously present at output A1 of observer unit 3. If observer unit 3 is activated, the estimated track-banking angle Φb present at output A1 of unit 16 and observer 3 is determined by the additional incorporation of path data, as described above.

In the angle-of-inclination generator unit 4 downstream of observer unit 3, an angle of inclination $\phi_N$ with respect to the chassis is calculated from the observed track-banking angle Φb, the train speed v, the angular speed ωG (yaw speed) and the gravitational acceleration g. This angle $\phi_N$ is then supplied to control system 5 as the nominal value, that is, the actuation and switching signal $\phi_N$ for the car-body inclination system. The control system 5 is only activated if a threshold value is exceeded. Angle of inclination $\phi_N$ is calculated or generated in a known manner.

The invention now being fully described, it will be apparent to one of the ordinary skill in the art that any changes and modifications can be made thereto without departing from the spirit or scope of the invention as set forth herein.

What is claimed:

1. A method of generating a sensor signal related to a track banking angle of a banked section of track beings traverse by a train said method comprising the steps of: providing measured signal values for the train speed (v), for the angular speed of a train car chassis about the roll axis (ωR) for the transverse acceleration (aq), and for the yaw speed (ωG) of the chassis about the yaw axis; and determining a track-banking angle value (Φg) from the rolling angular speed (ωR) and yaw speed (ωG) of the chassis about the yaw axis; and wherein the step of determining a track-banking angle (Φg) includes: estimating the track-banking angle from the measured rolling angular speed (ωR) as a track banking angle (Φgb); comparing this estimated track-banking angle (Φgb) to a track banking angle (Φgs) determined from the transverse acceleration (aq), the measured yaw angular speed (ωG) and the train speed (v), to provide a difference signal value (ΔΦg); feeding back and filtering the formed difference signal value (ΔΦg) to combine with the estimated track-banking angle (Φgb) and provide a resulting, estimated track-banking angle (Φb) representing the real track-banking angle (Φg), which is drift-compensated and low-noise.

2. The method as defined in claim 1, further comprising supplying the measured signals of the rolling angular speed (ωR) online to a simulated gyro system serving as an inverse model of a measured-value generator for the rolling angular speed (ωR) to provide the estimated values of the track-banking angle.

3. The method as defined in claim 1, further comprising incorporating sensor components of the measured-value generator for the rolling angular speed (ωR) into the simulated inverse gyro system.

4. The method as defined in claim 1, further comprising increasing the dynamics of the generation of the sensor signal (φg) by activating an observer which further modifies and corrects the estimated track-banking angle (Φb) on the basis of retrieved stored known path information.

5. The method as defined in claim 4, wherein the step of increasing the dynamics includes: determining the instantaneous position of the train by integration of the train-speed value (v); in a mission monitor, utilizing the train-speed value (v) to read out track-banking values stored in a knowledge base, comparing the estimated track banking value to the stored track banking values of the knowledge base, and, when a path is recognized, activating the observer to output the track-banking value read out of the knowledge base.

6. The method as defined in claim 5, wherein: the track-banking value (Φgw) read out of the knowledge base when the mission monitor recognizes the path is used to generate an actuation signal ($\phi_N$) for a control system for regulating the angle of inclination of the car chassis to control the inclination caused by the control system; and, for a more precise determination of the track-banking value read out of the knowledge base, the estimated track-banking angle (Φb) is compared to the known track-banking angle (Φgw) from the knowledge base, and the difference (ΔΦs) is used to readjust the track-banking angle value (Φgw) as a representation of the real track-banking angle (Φg).

7. The method as defined in claim 1 further comprising calculating an angle of inclination actuation signal ($\phi_N$) for a control system for regulating the angle of inclination of the car chassis from the track-banking angle (Φg), the train speed (v), the yaw speed (ωG) and the gravitational acceleration (g).

8. An apparatus for generating a sensor signal related to a track-banking dependent inclination of a car-chassis of a train traversing a section of banked track, said apparatus comprising: a plurality of measured-value generators for respectively determining the train speed (v), the roll angular speed (ωR) of the chassis about the roll axis, the yaw angular speed (ωG) and the transverse acceleration (aq) of the car body; and means for determining a track-banking angle (Φg) by combining the measured yaw angular speed value (ωG) from the measured valued generator for measuring the yaw angular speed (ωG), the measured transverse acceleration value (ag) from the measured value generator for determining the transverse acceleration (aq), and the measured roll angular speed value (ωR) from the measured-value generator for determining the angular speed (ωR).

9. An apparatus for generating a sensor signal related to a track-banking dependent inclination of a car-chassis of a train traversing a section of banked track, said apparatus comprising: a plurality of measured-value generators for respectively determining the train speed (v), the roll angular speed (ωR) of the chassis about the roll axis, the yaw angular speed (ωG) and the transverse acceleration (aq) of the car body; and means for determining a track-banking angle (Φg) by combining the measured yaw angular speed value (ωG) from the measured value generator for the yaw angular speed (ωG), and the measured roll angular speed value (ωR) from the measured-value generator for determining the angular speed (ωR); and wherein the means for combining includes at least a first observer means for determining an estimated track-banking angle (Φgb) installed between the measured-value generators and a control system.

10. The apparatus as defined in claim 9, wherein: said first observer means comprises: a simulated inverse gyro system as a model of the measured-value generator for the roll angular speed (ωR) of the chassis about the roll axis for providing an estimated track-banking angle (Φgb) from the roll angular speed (ωR), a comparator, and a measured-value evaluation means for calculating a track-banking angle (Φgs) from the measured values of the vehicle speed (v), the yaw angular speed (ωG), and the transverse acceleration (aq); the inverse gyro system has a first input connected to an output of the measured-value generator for the roll angular speed (ωR), a second input connected to an output of the comparator, and an output connected to a first input of the comparator; and a further input of the comparator is connected to an output of the measured-value evaluation means.

11. The apparatus as defined in claim 10, wherein the further observer means comprises: an integrator for integrating the train speed value (v); a knowledge base for storing known path data including track banking angle values; a mission monitor having a first input connected to an output of the integrator, a second input connected to an output of the knowledge base, a third input connected to the output of the first observer means, and an output connected to an input of the knowledge base, said mission monitor determining the instantaneous position of the train using the integrated train-speed value and comparing the estimated track-banking value from the first observer means with the stored track-banking values in the knowledge base and outputting the stored track-banking value when a comparison is found; a correction means for correcting the track-banking value output of the mission monitor, with the correction means having a first input connected to the output of the mission monitor, a second input connected to the output of a comparator, and an output connected to a first input of the comparator; and the comparator has a second input connected to said output of said first observer means.

12. The apparatus as defined in claim 9, wherein a further observer means for increasing the dynamics of the generation of the sensor signal is connected downstream of the first observer means.

13. The apparatus as defined in claim 9, wherein an angle-of-inclination generator means for generating an angle of inclination from the estimated track-banking angle (Φgb) for use by the control system is connected downstream of the observer means.

* * * * *